US008771586B2

(12) United States Patent
Meng

(10) Patent No.: US 8,771,586 B2
(45) Date of Patent: Jul. 8, 2014

(54) GAS BARRIER

(76) Inventor: Fanli Meng, Cranford, NJ (US)

( * ) Notice: Subject to any disclaimer, the term of this patent is extended or adjusted under 35 U.S.C. 154(b) by 150 days.

(21) Appl. No.: 13/383,069

(22) PCT Filed: Jul. 9, 2010

(86) PCT No.: PCT/IB2010/002263
§ 371 (c)(1),
(2), (4) Date: Jan. 9, 2012

(87) PCT Pub. No.: WO2011/004268
PCT Pub. Date: Jan. 13, 2011

(65) Prior Publication Data

US 2012/0118106 A1 May 17, 2012

(30) Foreign Application Priority Data

Jul. 10, 2009 (GB) ..... 0911973.6

(51) Int. Cl.
*C21D 11/00* (2006.01)
*C22B 5/02* (2006.01)

(52) U.S. Cl.
USPC ..... 266/80; 266/87; 266/90; 266/146; 266/155; 266/173; 266/901; 110/246

(58) Field of Classification Search
USPC ..... 266/173, 146, 155, 80, 87, 90, 901; 110/246
See application file for complete search history.

(56) References Cited

U.S. PATENT DOCUMENTS

| | | | | |
|---|---|---|---|---|
| 3,963,416 | A | 6/1976 | Mach | |
| 4,734,166 | A | 3/1988 | Angelo, II | |
| 5,122,181 | A * | 6/1992 | Dube et al. | 75/10.21 |

FOREIGN PATENT DOCUMENTS

| | | | |
|---|---|---|---|
| CN | 101457935 | A | 10/2008 |
| EP | 1852653 | A2 | 11/2007 |
| GB | 2257239 | A | 6/1993 |
| JP | 2006308172 | A | 11/2006 |
| WO | 2008122896 | A2 | 10/2008 |
| WO | 2009010100 | A1 | 1/2009 |

OTHER PUBLICATIONS

Search Report and Written Opinion for PCT/IB2010/002263.
State Intellectual Property Office of P.R. China the First Office Action in relation to Application No. 201080030961.7 dated Dec. 18, 2013; 18 Pages.
British Search Report dated Oct. 29, 2009 in relation to Application No. GB0911973.6.

* cited by examiner

*Primary Examiner* — George Wyszomierski
*Assistant Examiner* — Tima M McGuthry Banks
(74) *Attorney, Agent, or Firm* — Stetina Brunda Garred & Brucker

(57) ABSTRACT

An apparatus for processing material such as organically coated waste and organic materials including biomass, industrial waste, municipal solid waste and sludge, is provided. The apparatus comprises a rotatable and tiltable furnace (1) having a body portion (15), a single material entry point (11) and a tapered portion (13) between the entry point and the body. The furnace has a closure through which material can be introduced to the furnace (1) when open and in which the interior of the furnace is isolated from the external environment when closed. A director at or adjacent the entry point (11) directs gases inwardly of the furnace so as to provide a barrier of gas adjacent the opening to inhibit the entrance of oxygen containing atmospheric gas when the closure is in its open position.

13 Claims, 4 Drawing Sheets

GAS BARRIER

CROSS-REFERENCE TO RELATED APPLICATIONS

The present application claims priority to International Application No. PCT/IB2010/002263 filed on Jul. 9, 2010, which claims priority to Great Britain Patent Application No. 0911973.6 filed on Jul. 10, 2009.

TECHNICAL FIELD

This invention relates to an apparatus for and method of processing organically coated waste and organic materials including biomass, industrial waste, municipal solid waste and sludge.

BACKGROUND OF THE INVENTION

A one-open end tilting rotary furnace is used in the metal industry to melt dirty metal (see for example U.S. Pat. No. 6,572,675 in the name of Yerushalmi, U.S. Pat. No. 6,676,888 in the name of Mansell) such as aluminium, from scrap that contains impurities, including organic material. Mare specifically, these furnace are used for aluminium dross processing. Typically these furnaces operate at a high temperature, for example in the range of 1400° F. to 2000° F. generally, after processing the metal scrap is in a molten state (fluid condition). These furnaces use either air fuel burners or oxy-fuel burners to heat and melt the metal scrap in the furnace. Typically these furnaces use burners that operate with an oxygen to fuel ratio in the range of 1.8 to 1.21 as stated in U.S. Pat. No. 6,572,675 (Yerushalmi). This range ensures that almost full oxidation takes place of the fuel injected in the furnace inner atmosphere. This high oxygen/fuel ratio ensures the high fuel efficiency (BTU of fuel used per Lb of aluminium melted) in these tilting rotary furnaces.

Furthermore, with all of these types of furnaces the exhaust gas is collected in an open hood system as presented in U.S. Pat. No. 5,572,675 (Yerushalmi) and U.S. Pat. No. 6,676,888 (Mansell). The open hood system is designed to engulf and collect the exhaust gases exhausted from the rotary furnace. The open hood system collects along with the hot exhaust gases a wide range of impurities (unburned organics, particulates, and other impurities). These impurities are entrained in the hot gases and carried with it. The open hood system also entrains, in addition to the hot exhaust gases, a considerable amount of ambient air (from outside the furnace) into the hood, leading to a full mixture of the air and the polluted exhaust gases.

US patent application no. 2005/0077658 in the name of Zdolshek discusses an open hood system that receives the polluted gases, along with the entrained air and passes it through a fume treatment system where the particulates are largely removed by a cyclone and the hydrocarbons are incinerated in a separate standalone incinerator. The gases exiting the incinerator are exhausted toward a baghouse. This arrangement is designed so as to treat the gases prior to exhausting it.

An example of using the exhausted gases to recover some heat from the flue is disclosed in U.S. Pat. No. 4,697,792 in the name of Fink. In this patent the hot gases travel inside a recuperator which uses these gases to preheat the combustion air which is then blown through a blower into the burner. Hence, it is an open circuit system, with exhaust gases used only for preheating the combustion air.

Typically in these furnaces, at the end of the melting cycle, the furnaces tilt forward, and empty the molten metal first into metal skull containers. Then the residue which could be a combination of iron, and other residual impurities including salts used in the process, and aluminium oxides, are skimmed from the furnace internals through protruded skimming devices.

The advantages of the tilting rotary furnace (a single operational entry point furnace) mentioned in U.S. Pat. No. 4,697,792 (Fink), U.S. Pat. No. 6,572,675 (Yerushalmi) and U.S. Pat. No. 6,676,888 (Mansell) over a conventional fixed rotary furnace (two opposed operational entry points), are:

- Rapid pouring of the molten metal (controlled via gravity)
- Rapid pouring of the molten metal residue (salts, aluminium oxides, etc) that results post processing the scrap metal.
- Larger heat transfer surface area with the furnace wall which permits higher heat transfer between the furnace internal refractory walls and the metal scrap, hence accelerate the melting process, with reduced fuel usage.
- Larger gases resident time—two passes for the hot combustion gases along the longitudinal path of the rotary furnace (two flights), ensure higher heat transfer, which also translates into higher melting capacity.

An example of using sub-stoichiometric hot gases to gasify waste from a rotary furnace is listed in U.S. Pat. No. 5,553,554 (Urich) which describes using a continuously operated furnace with two opposed entry points (and not a single entry point tilting rotary furnace) to gasify the waste. In the aforementioned patent, the organic waste is fed via a hopper with ram feeding into the rotary furnace in a continuous manner. Furthermore, in this system a burner is installed in the rotating furnace with induce air to provide direct flame heating into the furnace. The system process control does not have a mechanism to predict when the organics have been fully gasified. Hence, the system operates on a fixed processing time for the waste, irrespective of the amount of organics in the waste. This naturally lead to either overcooked waste material (wasting of energy), or undercooked material (organics are not fully burned, and the waste still smothering at the exit of the furnace with the ash material (which creates both environmental issues and loss of potential energy in the form of unburned hydrocarbon). A further problem with such furnaces is that when the furnace door is opened to allow more material to be loaded into the furnace this allows oxygenated gas (air) into the furnace, resulting in a lowering of temperature and oxidisation of the metal.

SUMMARY OF THE INVENTION

The present invention seeks to provide a method and apparatus for processing organic material and organic coated metals.

Accordingly, the present invention provides

The method of de-coating organic materials or waste materials, such as biomass, municipal solid waste, sludge, etc from metal scrap material utilizes a process generally known as gasification.

A preferred method utilizes a rotary tilting furnace with a single operational entry point, the furnace having a bottle shape, and being lined with refractory material that can withstand heavy loads and high temperatures which furnace can be rotated about its central longitudinal axis. The furnace has a single operational entry and includes a burner for heating the material being treated and an air tight door with provision for flue ducting to carry away the exhaust gases.

There is also provided a thermal oxidizer that incinerates the volatile organic compounds (VOC) gases released from the scrap or waste inside the rotary furnaces.

The thermal oxidizer may comprise a multi fuel burner that can use both virgin fuel (like natural gas or oil) and/or the VOC gases. An atmospheric conditioning system is provided to control the temperature inside the furnace and a second atmospheric conditioning system that control the temperature going to the baghouse is also provided A process control system is provided to maintain the furnace system combustion oxygen level below stoichiometry during the gasification process (<2%-12%). Furthermore, the control system maintains the correct gasification temperature inside the rotary tilting furnace (1000° F.-1380° F.), and inside the thermal oxidizer (about 2400° F.). Furthermore, the control system ensures that the system pressures are maintained stable throughout the cycle. The control system utilizes a combination of oxygen and carbon monoxide sensors, thermal sensors, gas analyzers and pressure sensors to receive the signals from inside the system.

The rotary furnace is preferably designed to operate at a temperature that is below the melting temperature of the metal scrap. The furnace heating is achieved via a burner or a high velocity lance which injects hot gases which are starved of oxygen in a so called sub-stoichiometric burn. Since the burn is depleted of oxygen (sub-stoichiometric), only partial oxidation of the scrap organics is achieved inside the rotary furnace atmosphere. This partial oxidation also provides part of the heat required for gasifying the organics from the scrap metal. The exhausted gases leave the rotary furnace atmosphere via ducting and include the volatile organic compounds (VOC). These gases are then incinerated to substantially full oxidation in the thermal oxidizer before being vented to the atmosphere.

The vertical thermal oxidizer fully incinerates the tars, and provides the 2 second residence time required for the full oxidation of the volatile organic compounds liberated from the metal scrap inside the rotary furnace. To achieve this, the thermal oxidizer operates at a high temperature reaching [2400° F.] with oxygen levels in the range of 2%-12%, and through mixing between the volatile organic compounds and the oxygen. The thermal oxidizer uses a multi-fuel burner to heat the thermal oxidizer atmosphere. This multi fuel burner is designed to burn both virgin fuel (natural gas, oil diesel, and volatile organic compound gases received from the rotary furnace.

Subsequently the gases are vented to the atmosphere possibly after downstream treatments to remove particulates or noxious gases.

In one embodiment the hot gases pass from the oxidizer through an atmospheric conditioning system, where both the gas temperature and oxygen level are adjusted according to the loaded scrap type, and requirements for the rotary furnace operation. Typically for de-coating purposes, the gas temperature is maintained below 1000° F., and the oxygen level is maintained in the range 2%-12%, depend on the material, and the de-coating phase. For waste (including biomass, municipal solid waste, industrial waste, and sludge) gasification, the gas temperature may be as high as 1380° F., and the oxygen level maintained below 4%.

These gases then travel back to the rotary furnace with the conditioned temperature (lower than metal melting temperature) and oxygen level (sub-stoichiometric) and are introduced into the rotary furnace inner atmosphere via a high velocity nozzle. These gases travel inside the rotary furnace at high velocities which impinge on the metal scrap. Part of the rotary furnace operation is the continuous rotation, while the nozzle or lance injects the sub-stoichiometric gases from the oxidizer. The rotation of the furnace aids the mixing of the scrap, and also the exposure of the metal scrap to the heat stream of impinged gases, thereby renewing the scrap. The speed of the furnace rotation and the degree of the burner burn or speed of the lance gas injection are dependent on the material to be processed. These parameters are defined by the control system logic, and rely on the production requirements and type of material to be processed. The rotary furnace atmosphere during the metal scrap de-coating process is predominately maintained at the following conditions (Temperature <1000° F., and the oxygen level <2%-12%). These two conditions insure that the aluminium metal scrap does not get oxidized.

Several sensors are installed inside the rotary furnace so as to send a continuous stream of data while the furnace in operation. These sensors include thermocouples that measure the atmospheric temperature as well as pressure sensors, oxygen sensors, and CO sensors. This data is continuously logged and the signals sent to the process control system. The process control system uses this data to adjust the various parameters including the lance (return gas) temperature, oxygen level, lance velocity, and the rotary furnace rotational speed. To control the de-coating finishing time, both the gases entering the rotary furnace and the gases exiting the rotary furnace are monitored in a closed circuit by a detailed gas analyzer. The gas analyzer records both the oxygen level and the CO level.

During the de-coating operation, the oxygen level exiting the rotary furnace is lower than the levels entering the rotary furnace and exactly the opposite for the CO levels. Toward the completion of the de-coating process, the organics inside the furnace are predominately gasified, and both the CO level, and the Oxygen level move closer and finally become equal. This levelling of the two signals from the gas analyzers in the ducting signals the exhausting of all the organics in the gases and the completion of the de-coating/gasification process.

The use of a tilting, rotary de-coating furnace with gases recirculated from the oxidizer provides a very efficient thermal delivery operation. In addition, one of the requirements for the furnace de-coating operation is the tight seal where the gases leave the furnace for the oxidizer and the prevention of any air entrainment into the rotary tilting de-coating furnace. This requirement ensures no extra cooling of the furnace occurs during operation and also prevents accidental rapid ignition of the VOC gases inside the rotary furnace or the ducting from the furnace, and even the possibility of explosion.

BRIEF DESCRIPTION OF THE DRAWINGS

The present invention is further described hereinafter, by way of example, with reference to the accompanying drawings, in which.

DESCRIPTION OF THE INVENTION

Figure 1:
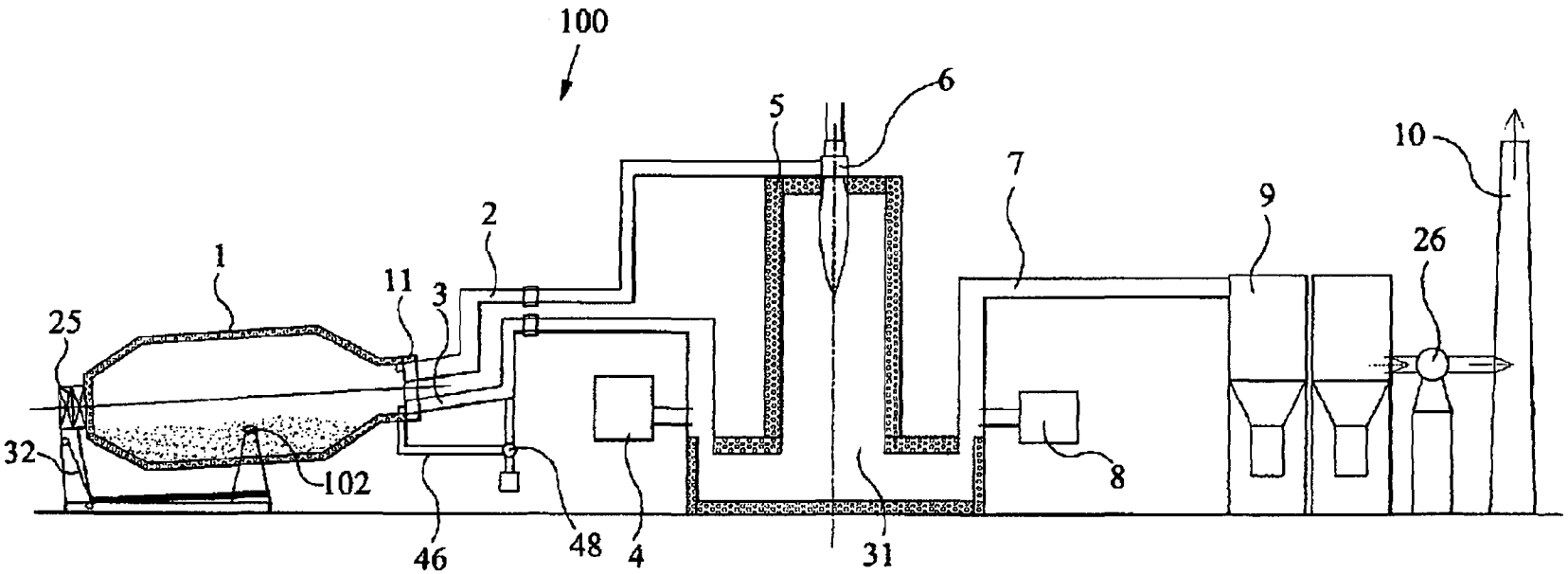
FIG. 1 is a side view, partially in section, of a preferred form of apparatus according to the present invention, showing a tilting rotary furnace, a thermal oxidizer, and a bag house.
Figure 2B:
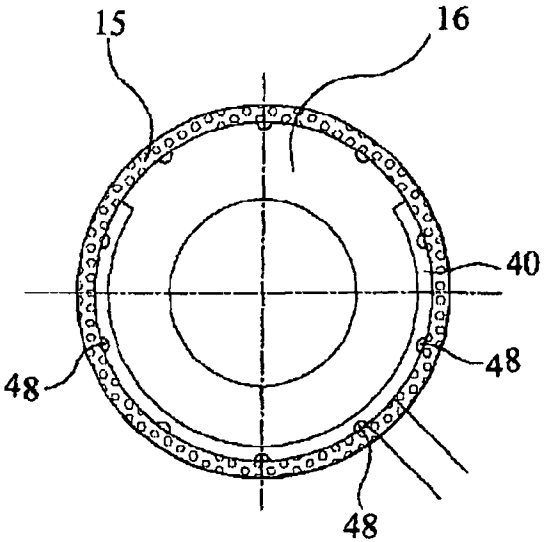
FIG. 2*b* is a cross section through the furnace of FIG. 2*a;*
Figure 2A:
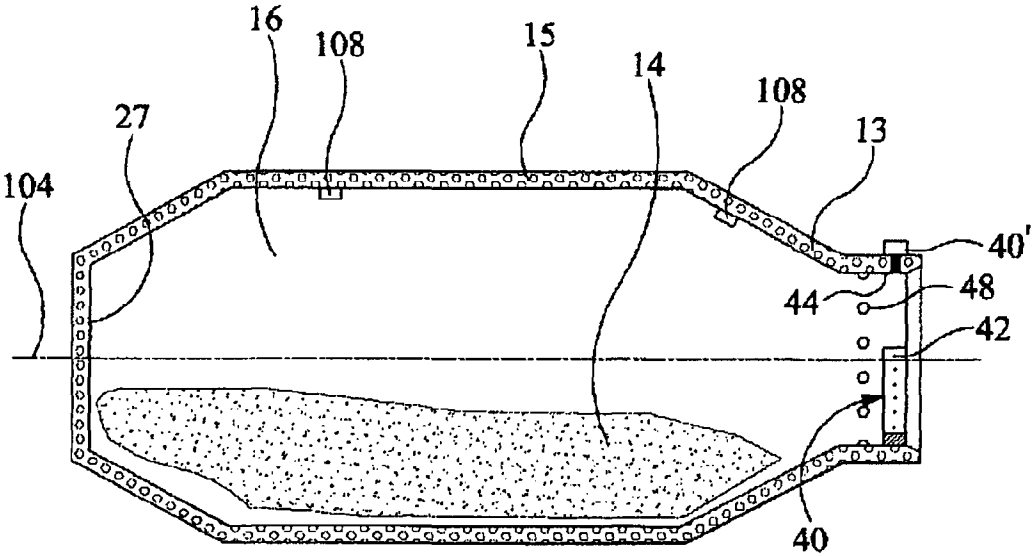
FIG. 2*a* is a sectional view of the tilting rotary furnace, showing the furnace internals.
Figure 3:
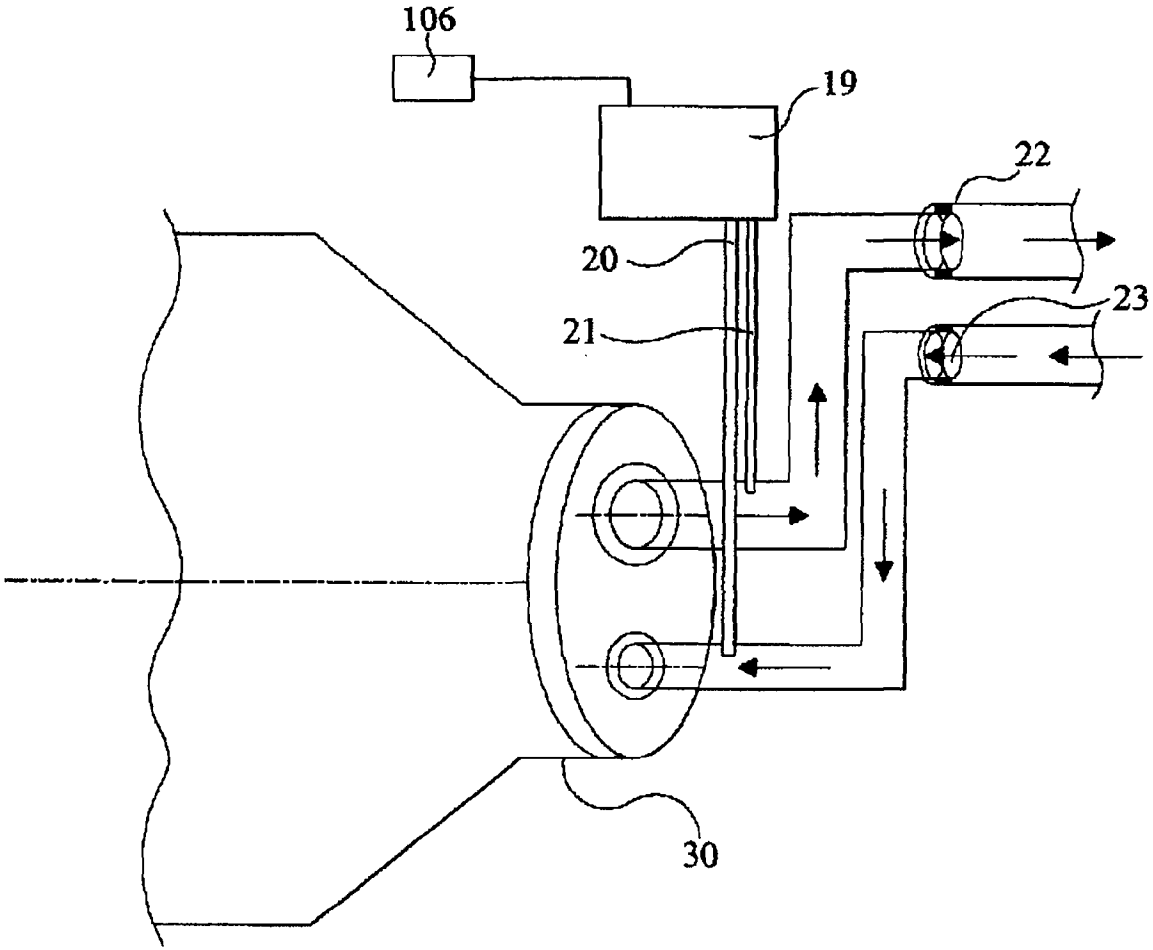
FIG. 3 is a diagrammatic view of the furnace door showing the flue ducting and fuel lance connections.
Figure 5:
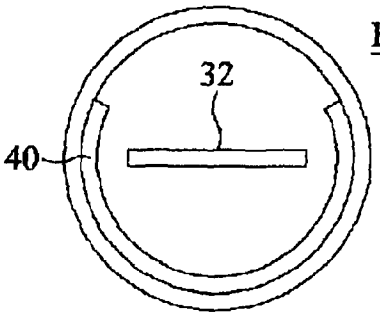
FIG. 5 is a view in the direction of arrow A of FIG. 4.
Figure 4:
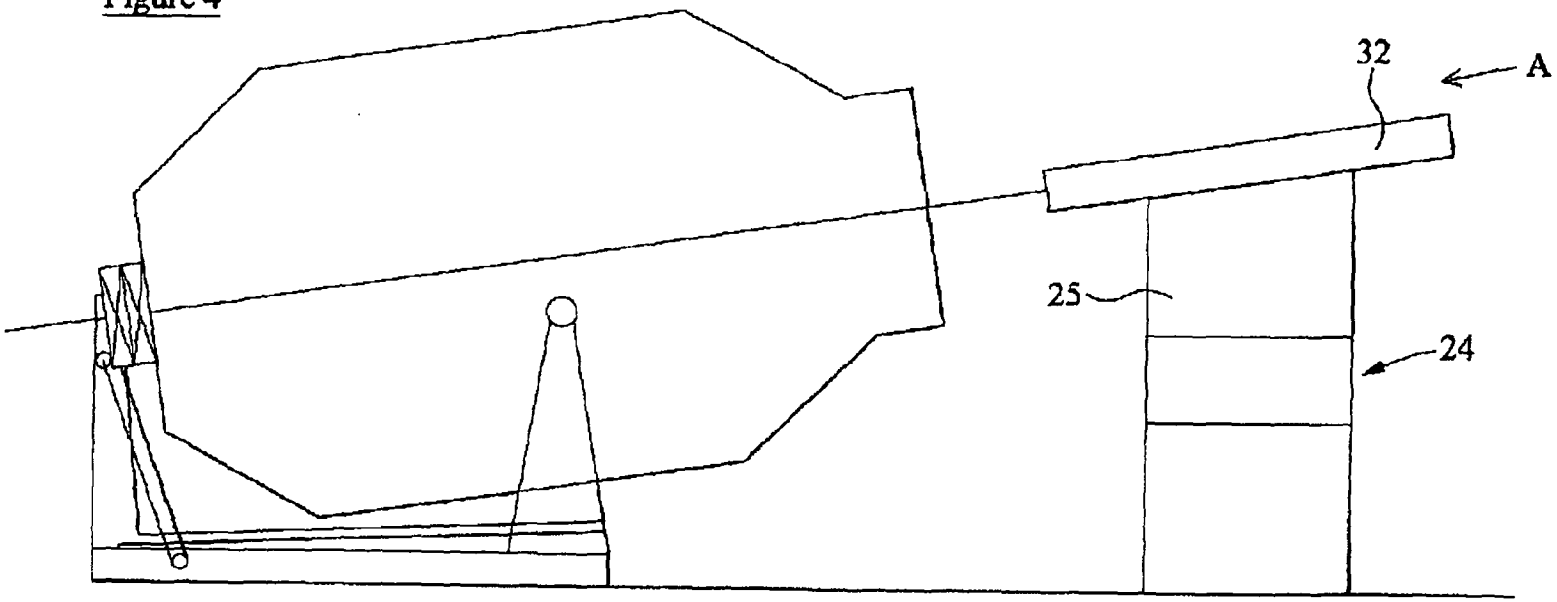
FIG. 4 shows the metal scrap or waste feeding mechanism for the rotary furnace.

FIGS. 1-5 show a preferred form of apparatus 100 for decoating organics in metal scrap and/or gasifying organic material to generate synthetic gas (syngas). The apparatus has a single entry tilting rotary furnace 1 which feeds gases through passage means in the form of an exhaust ducting 2 to an oxidising means in the form of a thermal oxidizer 31 and then to a separator 9, fan or blower 26 and exhaust means (chimney) 10.

The separator 9 is commonly known as a baghouse and is used to separate dust and particulates from the gas stream. Hot gases from the thermal oxidizer 31 are fed back to the furnace drum 15 by way of passage means in the form of a return ducting 3.

The furnace comprises a refractory lined drum 15, a door 11, an air conduit means 32 and a drive mechanism 25 that is used to rotate the furnace about its longitudinal axis 104. The furnace drum has a tapered portion 13 near the furnace door 11 to permit better gas flow circulation around metal and/or organics scrap 14 in the furnace and better control over the loaded scrap 14 during discharge.

The furnace 1 is mounted for tilting forwards and backwards about a generally horizontal pivot axis 102. A hydraulic system 32 is used to tilt the rotary furnace 1 forward, about the axis 102, during discharge, and slightly backward during charging and processing of the material 14 (as shown in FIG. 1) to improve the operational characteristics of the furnace.

The furnace door 11 is refractory lined and equipped with an elaborate door seal mechanism 12 which allows rotation of the furnace drum 15 relative to the door 11 and ensures tight closure and complete separation between the rotary furnace internal atmosphere 16, and the external atmosphere 30. The furnace door 11 has two apertures or hole 28, 29. One aperture 28 is sealingly connected to the exhaust ducting 2 and the second aperture 29 is sealingly connected to the return conduit 3. Both of these apertures are designed so as to maintain a robust seal that prevents atmospheric air from leaking into the rotary furnace atmosphere 16 during operation.

During the operation the rotary furnace drum 15 is tilted slightly backward as shown in FIG. 1 and the furnace door 11 is tightly closed. The furnace is rotated by the drive mechanism 25. The hot sub-stoichiometry gases are introduced into the furnace from the conduit 3 via a high velocity nozzle 18 which protrudes inside the furnace through the aperture 29. The nozzle is sealed to the aperture 29. Similarly, the exhaust ducting 2 is coupled to the interior of the furnace through the aperture 28 by way of an inlet 17. Both the exhaust and return ducting 2, 3 have respective rotating airtight flanges 22, 23 (FIG. 3) that permit the door 11 to be opened without stressing the sealing of the ducting 2, 3 to the door 11.

The ducting 2 connects the exhaust gases from the furnace to a thermal oxidizer 31 where it is burnt in the heat stream from a burner 6 before those burnt gases are passed to the bag house 9.

The furnace 1 also has a passage means 40 for directing gas inwardly of the furnace wall. The passage means 40 is an elongate tube or conduit which extends circumferentially around the inner wall of the furnace 1. Preferably, the conduit is located at or adjacent the furnace opening and extends through a pre-selected angle which may be 360° or less than 360°, typically 240°. The passage means 40 also has a plurality of openings or nozzles 42 for directing gases into the furnace. These openings may be positioned and angled or orientated such that the gas is directed towards the longitudinal axis 104 of the furnace either at an angle of 90° to the longitudinal axis or at some other suitable angle. In a modification, the passage means 40 may be positioned externally of the furnace with the gases being introduced into the furnace by way of through-holes or nozzles 44 in the furnace wall. Again, these through-holes or nozzles may be orientated or angled so as to direct the gases towards the longitudinal axis 104 of the furnace at a pre-selected angle to the axis.

The passage means 40 may be formed by groups of conduits, each of which is separately supplied with gas to enable individual control of the gas pressure of their individual groups. It will be appreciated that each group of conduits may supply one or more openings 42, 44.

The gases may be drawn from the conduit 3 by way of a further conduit 46. The gases are oxygen depleted and, when the furnace door is opened, they provide a gas curtain to restrict the entry of oxygenated air into the furnace interior. The gas supply may be controlled by one or more valves 48 in the supply line(s) which controls the supply of gases to the conduit groups and/or openings 42, 44. The valve(s) 48 may be controlled by a process control system 106 to vary the pressure of the gases supplied to the openings 42, 44.

Alternatively, the gases supplied to the openings 42, 44 may be from sources such as bottled gas with the supply line(s) again controlled by one or more valves.

One or more of the openings 42, 44 may be formed by suitable high pressure or high velocity nozzles which may protrude inside the furnace.

As a further modification, each of the through-holes 44 in the furnace wall may be connected to a respective separate passage means such as a gas supply pipe to supply gases to the openings 44. the separate passage means may be formed in groups supplied by a respective, controlled gas pressure source, as described above. In addition, the pressure of the gases supplied to the openings 42, 44 may be controlled by suitable pressure control means such as one or more valves to enable the gas pressure exiting the through-holes to be varied. The gas pressure in the individual pipes may be varied independently of one another or in groups.

A plurality of sensors 48 may also be provided around the entrance to the furnace to monitor the oxygen content of the gases adjacent the entrance. These sensors provide signals to the process control system which can then control the gas pressure exiting the openings or nozzles 42, 44, individually or in selected groups, to provide a stronger or weaker barrier to air entering the furnace.

The thermal oxidizer 31 is a vertical cylindrical shape structure made of steel and is lined with a refractory material 5 that can withstand high temperatures of typically around 2400° F. The hot gases from the furnace 1 contain volatile organic compounds (VOCs) and the thermal oxidizer volume is designed so as to ensure that the VOC-filled gases are retained in the oxidizer for a minimum of 2 seconds residence time. The thermal oxidizer is heated by a multi-fuel burner 6 capable of burning both virgin fuel (such as natural gas or diesel) and the VOC from the furnace 1. The ducting 2 for the VOC gases is connected directly to the burner 6 and directly supplies the VOC as an alternative or additional fuel to the burner.

The gases in the thermal oxidizer 31 have two exit paths. One exit path is through the return ducting 3 to provide heating or additional heating to the rotary furnace 1. The second exit path is through a further passage means in the form of an exit ducting 7 towards the baghouse 9.

A gas-conditioning unit 4 is connected in the return ducting 3 and is used to condition the gas prior to its reaching the furnace. The conditioning unit 4 adjusts the gas temperature via indirect cooling and cleans both the particulates and acids from the gas. A second gas-conditioning unit is also provided in the exit ducting 7 and adjusts the gas temperature via indirect cooling and cleans both the particulates and acids from the gas in a first phase of gas. The exit gases travel from the gas-conditioning unit 8 through the baghouse 9 and then through an ID fan 26 which assists movement of the gases along the ducting 7 and through the baghouse 9. The gases then exhaust via a chimney 10 to atmosphere.

The return gases passing along the ducting 3 towards the rotary furnace 1 are sampled prior to entering the rotary furnace by a sampling means 20 whilst the outlet gases from the furnace are sampled by a second sampling means 21 in the outlet ducting 2. The two sampling means are sampling systems which generate signals representative of various parameters of the gases such as temperature, oxygen content and carbon monoxide content. These signals are applied to a gas analyzer 19. The gas analyzer 19 analyses the signals and sends the results to the process control system 106.

Several sensors 108 are installed inside the rotary furnace 15 and send a continuous stream of data to the process control system 106 while the furnace in operation. These sensors are conveniently thermocouples that measure parameters such as the atmospheric temperature, pressure, oxygen content and CO content in the furnace and generate signals representative of the parameters. This data is continuously logged and the signals sent to the process control system 106 which also receives data representing the rotational speed of the furnace and the speed of the gases injected from the nozzle 18. The process control system can also be programmed with the type of material to be processed and adjusts the various operating parameters including the temperature of the return gases, oxygen level, return gas velocity and the rotary furnace rotational speed in dependence on the programmed values and/or the received signals. To control the de-coating finishing time both the return gases entering the rotary furnace and the gases exiting the rotary furnace are monitored in a closed circuit by the gas analyzer 19 which records both the oxygen level and the CO level. In addition, the control system 106 can also control the burner 6 to control the temperature in the oxidizer 31.

The process control system controls the processing cycle the end of the de-coating cycle based on the received signals.

The rotary tilting de-coating furnace uses a charging machine 24, for charging the metal scrap and/or organics into the furnace. During this operation, rotation of the furnace 1 is stopped, the door ills opened and the furnace is tilted backward to permit the scrap to be loaded and pushed toward the far end of the furnace and toward the furnace back wall 27. The same procedure is effected during a discharging operation except that the furnace is tilted forward to empty the de-coated scrap into the charging bin or a separate collection system. Conveniently, the charging machine includes a platform 32 on which the material is loaded. The platform is preferably tilted downwardly towards the furnace and is moved forward to project partially into the furnace. A vibrating means 25 in the form of a vibrator is also provided to vibrate the platform to assist charging of material into the furnace. The vibrator can be mechanically or electrically driven. The platform may be of any suitable shape such as flat (planar), part cylindrical or with a generally flat base and upwardly curved walls.

The embodiment of FIG. 1 uses recycled gases with the oxygen content below the stoichiometric level (more specifically <12% by wt of oxygen) partially to combust the organics in the tilting rotary furnace. The gasified organics depart the furnace from the flue, in a complete closed circuit where no air is allowed to entrain into the flue gases. These organic filled gases (synthetic gases) are either fully incinerated in a separate thermal oxidizer, where a stoichiometric burner uses either natural gas or liquid fuel to ignite the synthetic gas, or it is partially oxidised via a burner and other portions of the synthetic gas are collected and stored for further use. The system identifies when the organics are fully gasified, and the metal scrap is fully clean.

It will be appreciated that any feature of any embodiment may be used in any other embodiment.

The invention claimed is:

1. An apparatus for processing organically coated waste, organic materials, biomass, industrial waste, municipal solid waste and sludge, comprising:

a rotatable and tiltable furnace having a body portion comprising an interior and a exterior, a single material entry point having a closure movable between an open position in which material can be introduced to the furnace and a closed position in which the interior of the furnace is isolated from the external environment; and a tapered portion between said entry point and said body portion of the furnace;

means for rotating the furnace about its longitudinal axis;

means for tilting the furnace;

and at least one director at or adjacent said entry point configured to direct gases in a direction inwardly of said furnace such that a barrier of gas is provided adjacent said opening to inhibit the entrance of oxygen containing atmospheric gas, when said closure is in its open position.

2. An apparatus as claimed in claim 1 further comprising an oxidizer configured to at least partially oxidize volatile organic compounds (VOC) in gases released by processing of said material; and a passage for conducting said gases from said furnace to said oxidizer;

wherein said gases comprise oxygen and carbon monoxide; and wherein said passage is sealed to said furnace and said oxidizer thereby to prevent ingress of external air.

3. An apparatus as claimed in claim 2 wherein the oxidizer comprises a multi-fuel burner.

4. An apparatus as claimed in claim 2 further comprising:

a gas analyzer configured to monitor a level of oxygen and carbon monoxide in the gas in said passage and to provide a signal representative of each level.

5. An apparatus as claimed in claim 2 further comprising a controller configured to control a temperature within the furnace and the oxidizer.

6. An apparatus as claimed in claim 5 wherein the controller is configured to control the oxygen level in the furnace between 2% and 12% by weight.

7. An apparatus as claimed in claim 5 wherein the controller is configured to control the oxygen level in the oxidizer between 2% and 12% by weight.

8. An apparatus as claimed in claim 5 wherein the controller is configured to control the temperature in the oxidizer at a level below 2400° F.

9. An apparatus as claimed in claim 2 further comprising a controller wherein:

the furnace has a plurality of sensors for monitoring selected parameters of the furnace and generating signals representative thereof;

the controller configured to control the operation of at least one of the furnace and the oxidizer in dependence on the signals; and the controller is configured to control a temperature of the rotary furnace to a level below a melting temperature of metal scrap and at a temperature sufficient to gasify organics in the waste or metal scrap.

10. An apparatus as claimed in claim 9 wherein the controller is configured to control the temperature of the rotary furnace to a level below 1400° F.

11. An apparatus as claimed in claim 1 further comprising a passage configured to conduct hot gases from said oxidizer to said furnace thereby to assist heating of material in said furnace.

12. An apparatus as claimed in claim 1 wherein said at least one director comprises a conduit extending circumferentially around an inner wall of said furnace.

13. An apparatus as claimed in claim 1 further comprising a charger configured for charging said material into said furnace.

* * * * *